US010280688B2

(12) United States Patent
Dunbar et al.

(10) Patent No.: US 10,280,688 B2
(45) Date of Patent: May 7, 2019

(54) ROTATING SUPERHARD CUTTING ELEMENT

(71) Applicant: Halliburton Energy Services, Inc., Houston, TX (US)

(72) Inventors: Bradley David Dunbar, The Woodlands, TX (US); William Brian Atkins, Houston, TX (US); Roddy Harwell, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/539,976

(22) PCT Filed: Jan. 26, 2015

(86) PCT No.: PCT/US2015/012855
§ 371 (c)(1),
(2) Date: Jun. 26, 2017

(87) PCT Pub. No.: WO2016/122438
PCT Pub. Date: Aug. 4, 2016

(65) Prior Publication Data

US 2018/0010396 A1 Jan. 11, 2018

(51) Int. Cl.
*E21B 10/573* (2006.01)
*E21B 10/567* (2006.01)
(Continued)

(52) U.S. Cl.
CPC ..... *E21B 10/573* (2013.01); *E21B 10/55* (2013.01); *E21B 10/5673* (2013.01); *E21B 10/5676* (2013.01); *E21B 2010/545* (2013.01)

(58) Field of Classification Search
CPC .... E21B 10/573; E21B 10/55; E21B 10/5673; E21B 10/5676; E21B 10/545
See application file for complete search history.

(56) References Cited

U.S. PATENT DOCUMENTS 4,913,244 A 4/1990 Trujillo
5,199,832 A 4/1993 Meskin et al.
(Continued)

FOREIGN PATENT DOCUMENTS

CN 102933786 2/2013
WO 2013/085869 6/2013

OTHER PUBLICATIONS

International Search Report and Written Opinion from PCT Patent Application No. PCT/US2015/012855, dated Sep. 25, 2015; 18 pages.

(Continued)

*Primary Examiner* — D. Andrews
*Assistant Examiner* — Manuel C Portocarrero
(74) *Attorney, Agent, or Firm* — Baker Botts L.L.P.

(57) ABSTRACT

Systems and methods are disclosed for a rotating superhard cutting element. The rotating cutting element includes a substrate comprising a rotating portion and a stable portion. The stable portion has a cavity and is configured to be fixed to a blade of a drill bit. The rotating cutting element further includes a retainer that rotatably secures the rotating portion of the substrate in the cavity of the stable portion of the substrate, and a cutting layer on the rotating portion of the substrate. The cutting layer has a plurality of cutting surfaces. One of the plurality of cutting surfaces has a property different from another one of the plurality of cutting surfaces. The cutting layer is configured to rotate with respect to the stable portion of the substrate and use one of the plurality of cutting surfaces based on a characteristic of a formation to be cut.

20 Claims, 11 Drawing Sheets

(51) Int. Cl.
*E21B 10/55* (2006.01)
*E21B 10/54* (2006.01)

(56) References Cited

U.S. PATENT DOCUMENTS

| | | | |
|---|---|---|---|
| 5,303,785 | A | 4/1994 | Duke |
| 5,437,343 | A | 8/1995 | Cooley et al. |
| 5,871,060 | A | 2/1999 | Jensen et al. |
| 6,042,463 | A | 3/2000 | Johnson et al. |
| 6,045,440 | A | 4/2000 | Johnson et al. |
| 6,321,862 | B1 | 11/2001 | Beuershausen et al. |
| 6,672,406 | B2 | 1/2004 | Beuershausen |
| 7,188,692 | B2 | 3/2007 | Lund et al. |
| 7,292,967 | B2 | 11/2007 | McDonough et al. |
| 7,730,976 | B2 | 6/2010 | McClain et al. |
| 7,831,419 | B2 | 11/2010 | Cariveau et al. |
| 8,037,951 | B2 | 10/2011 | Shen et al. |
| 8,112,258 | B2 | 2/2012 | Durairajan et al. |
| 8,689,910 | B2 | 4/2014 | Doster |
| 8,739,903 | B2 | 6/2014 | Denoix et al. |
| 8,783,387 | B2 | 7/2014 | Durairajan et al. |
| 9,074,435 | B2 | 7/2015 | Scott et al. |
| 2002/0129937 | A1* | 9/2002 | Cravatte ..... E21B 25/08 166/264 |
| 2009/0020339 | A1 | 1/2009 | Sherwood |
| 2010/0263939 | A1 | 10/2010 | Hall et al. |
| 2012/0273281 | A1 | 11/2012 | Burhan et al. |
| 2013/0220707 | A1 | 8/2013 | Shen et al. |
| 2013/0292185 | A1 | 11/2013 | Knull et al. |
| 2014/0345951 | A1 | 11/2014 | Shen et al. |

OTHER PUBLICATIONS

Wise, Jack L., et al. "Effects of design and processing parameters on performance of PDC drag cutters for hard-rock drilling." Transactions—Geothermal Resources Council (2002); 11 pages.

National Oilwell Varco, "Improving the Versatility of Fixed Cutter Bits," Nov. 8, 2013; 3 pages.

International Preliminary Report on Patentability for PCT Patent Application No. PCT/US2015/012855, dated Aug. 10, 2017; 10 pages.

Office Action received for Canadian Patent Application No. 2971150, dated May 15, 2018; 5 pages.

Office Action for Chinese Patent Application No. 201580070685.X dated Sep. 10, 2018, no English translation; 8 pages.

* cited by examiner

ROTATING SUPERHARD CUTTING ELEMENT

RELATED APPLICATIONS

This application is a U.S. National Stage Application of International Application No. PCT/US2015/012855 filed Jan. 26, 2015, which designates the United States, and is incorporated herein by reference in its entirety.

TECHNICAL FIELD

The present disclosure relates generally to superhard cutting elements having a rotating cutting layer and downhole tools, such as bits, containing these elements.

BACKGROUND

Various types of tools are used to form wellbores in subterranean formations for recovering hydrocarbons such as oil and gas lying beneath the surface. Examples of such tools include rotary drill bits, hole openers, reamers, and coring bits. Rotary drill bits include fixed cutter drill bits, such as polycrystalline diamond (PCD) bits. A drill bit may be used to drill through various levels or types of geological formations. However, as the formation changes, for example, from lower compressive strength to higher compressive strength, a different configuration of cutting layer may be more efficient and/or effective.

BRIEF DESCRIPTION OF THE DRAWINGS

A more complete understanding of the present disclosure and its features and advantages thereof may be acquired by referring to the following description, taken in conjunction with the accompanying drawings, in which like reference numbers indicate like features, and wherein.

DETAILED DESCRIPTION

The present disclosure relates to cutting elements having a cutting layer bordered by a cutting face. The cutting layer is formed from a superhard material, such as a polycrystalline diamond (PCD) or cubic boron nitride. The cutting layer is attached to a rotating substrate portion, which is able to move with respect to a stable substrate portion. The stable substrate portion may be fixed to a downhole tool, such as a fixed cutter drill bit. For example, the cutting layers may be configured to rotate during drilling operations. Rotation of the cutting layers with respect to the stable substrate portion may occur based on a characteristic of the formation being cut, the wear of the cutting layer, or any other suitable criteria for modifying the cutting edge of the cutting layer. For example, when rotation is based on the wear of the cutting edge, the cutting layer rotates such that an unworn cutting edge begins cutting the formation.

In some embodiments, rotating the cutting layer may allow the cutting layer and associated cutting element to have an increased useful life and less cutting element replacement may be necessary. The cutting layer may be configured to rotate and cease rotation or otherwise restrain the cutting layer from rotating by various mechanisms and may be secured within a cutting element by various methods.

Further, based on a characteristic of the formation, a cutting edge with a particular set of characteristics may be a more effective and/or efficient cutting edge. For example, the cutting layer may have multiple backrake angles, bevels, chamfers, slopes, materials, or other properties may be based on the characteristics of the formation to be cut. Embodiments of the present disclosure and its advantages may be further understood by referring to FIGS. 1 through 8E, where like numbers are used to indicate like and corresponding parts.

Figure 1:
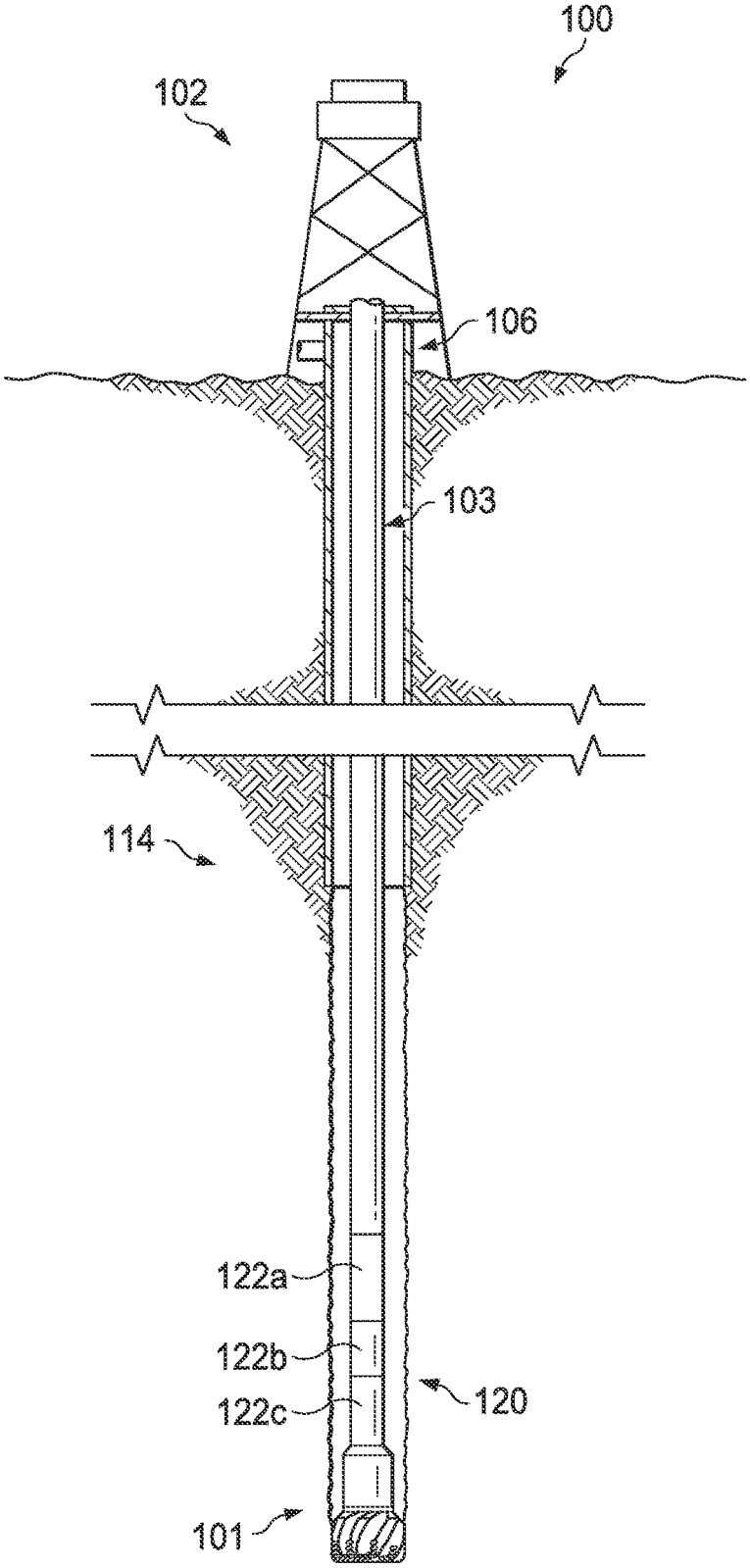
FIG. 1 illustrates an elevation view of an example embodiment of a drilling system in accordance with some embodiments of the present disclosure.

Cutting elements of the present disclosure may also be used in a drilling system, such as drilling system 100 in FIG. 1. Drilling system 100 is configured to provide drilling into one or more geological formations. Drilling system 100 may include a well surface, sometimes referred to as well site 106. Well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles and drilling barges (not expressly shown).

Drilling system 100 may include drill string 103 associated with drill bit 101 that may be used to form a wide variety of wellbores or bore holes and that may include cutting elements of the present disclosure. Bottom hole assembly (BHA) 120 may be formed from a wide variety of components configured to form a wellbore 114. For example, components 122*a*, 122*b* and 122*c* of BHA 120 may include, but are not limited to, drill bits (e.g., drill bit 101) drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components such as drill collars and different types of components 122 included in BHA 120 may depend upon anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of such logging tools and/or directional drilling tools may include, but are not limited to, acoustic, neutron, gamma ray, density, photoelectric, nuclear magnetic resonance, rotary steering tools and/or any other commercially available well tool. Drill bit 101 may be designed and formed in accordance with teachings of the present disclosure and may have many different designs, configurations, and/or dimensions according to the particular application of drill bit 101.

Figure 2:
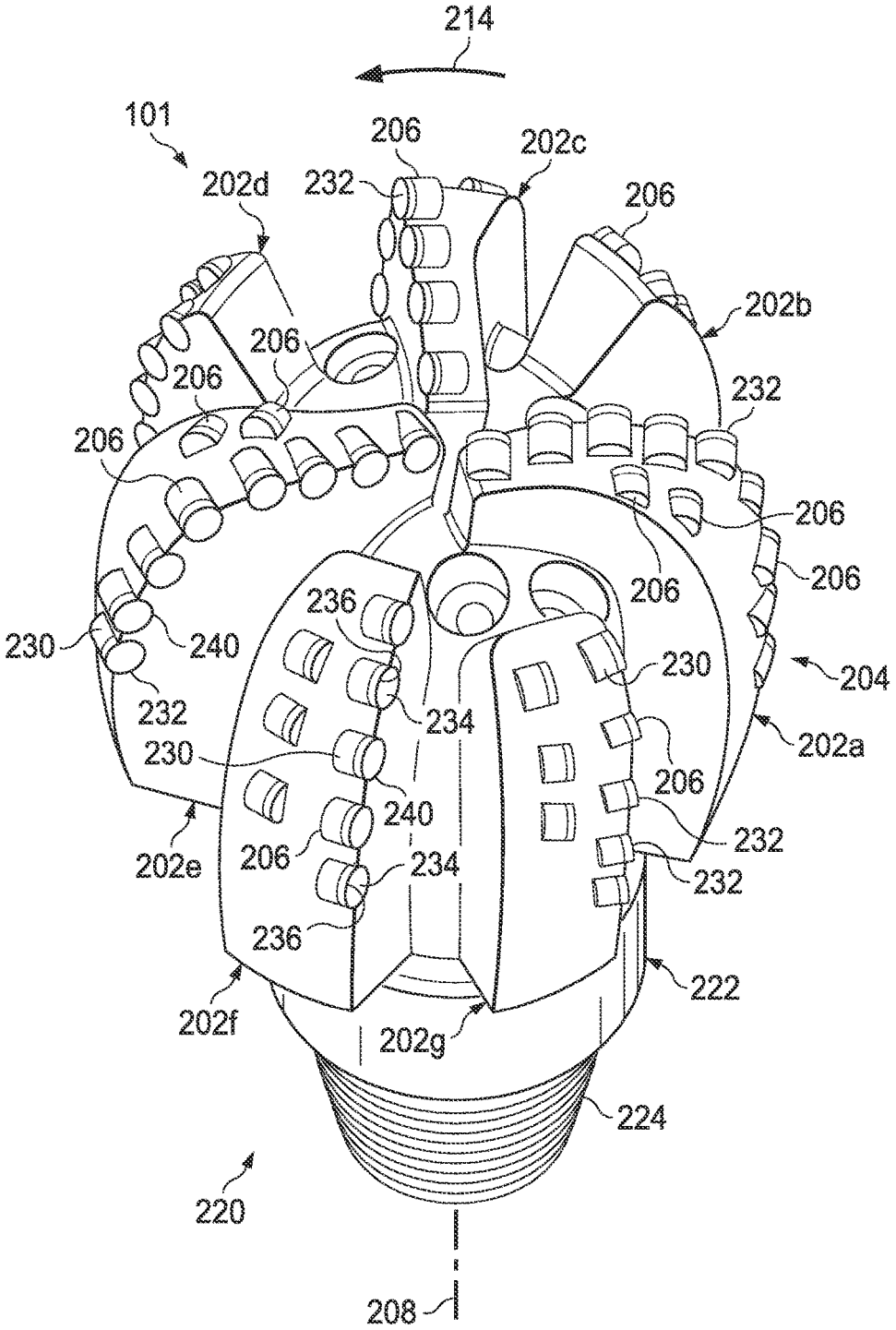
FIG. 2 illustrates an isometric view of a drill bit in accordance with some embodiments of the present disclosure.

Cutting elements of the present disclosure may be used in a downhole tool, such as a fixed cutter drill bit. FIG. 2 illustrates an isometric view of fixed cutter drill bit 101 in accordance with some embodiments of the present disclosure. Drill bit 101 may be any of various types of fixed cutter drill bits, including PCD bits, drag bits, matrix drill bits, and/or steel body drill bits operable to form a wellbore extending through one or more downhole formations. Other cutting tools that may benefit from the embodiments described herein include, but are not limited to, impregnated drill bits, core heads, coring tools, reamers, and other known downhole drilling tools.

Drill bit 101 may include one or more blades 202 (e.g., blades 202*a*-202*g*) that may be disposed outwardly from exterior portions of rotary bit body 204 of drill bit 101. Rotary bit body 204 may be generally cylindrical and blades 202 may be any suitable type of projections extending outwardly from rotary bit body 204. For example, a portion of blade 202 may be directly or indirectly coupled to an exterior portion of bit body 204, while another portion of blade 202 may be projected away from the exterior portion of bit body 204. Blades 202 formed in accordance with teachings of the present disclosure may have a wide variety of configurations including, but not limited to, substantially arched, helical, spiraling, tapered, converging, diverging, symmetrical, and/or asymmetrical.

Blades 202 and drill bit 101 may rotate about bit axis 208 in a direction defined by directional arrow 214. Blades 202 may include one or more cutting elements 206 disposed outwardly from exterior portions of each blade 202. For example, a base portion of cutting element 206 may be directly or indirectly coupled to an exterior portion of blade 202 while the cutting layer of cutting element 206 may be projected away from the exterior portion of blade 202. Cutting elements 206 may be any suitable device configured to cut into a formation, including but not limited to, primary cutting elements, backup cutting elements, secondary cutting elements or any combination thereof. By way of example and not limitation, cutting elements 206 may be various types of cutters, compacts, buttons, inserts, and gage cutters satisfactory for use with a wide variety of drill bits 101.

Cutting elements 206 may be retained in recesses or cutter pockets 240 located on blades 202 of drill bit 101. A brazing material, welding material, soldering material, adhesive, or other attachment material may be placed between substrates 230, particularly stable substrate portion 230*b*, and cutter pockets 240. Cutting element 206 may also be removed from cutter pocket 240 by re-heating the brazing material, then physically dislocating cutting element 206. A new cutting element 206 may then be inserted into cutter pockets 240 and attached via a braze joint. Cutting elements 206 may also be coupled to a blade, such as blade 202 of drill bit 101, by use of another securing mechanism. However, in some embodiments, cutting elements 206 may be coupled to any other component of drill bit 101, such as the top of blade 202 or as a back-up cutting element.

At least one cutting element 206 is a cutting element according to the present disclosure. In some embodiments, all cutting elements may be a cutting element according to the present disclosure. In some embodiments, at least one or all non-gage cutting elements may be a cutting element according to the present disclosure. According to another embodiment, at least one or all gage cutting elements may be a cutting element according to the present disclosure.

Uphole end 220 of drill bit 101 may include shank 222 with drill pipe threads 224 formed thereon. Threads 224 may be used to releasably engage drill bit 101 with a bottom hole assembly whereby drill bit 101 may be rotated relative to bit axis 208.

Cutting elements 206 may include cutting layer 232 disposed on one end of substrate 230. Cutting layer 232 includes a cutting face that engages adjacent portions of a downhole formation to form a wellbore when used on a drill bit, or performs a similar function on other downhole tools. Cutting layer 232 may include cutting face 234 and cutting edge 236. Contact of cutting face 234 and optionally also cutting edge 236 with the formation may form a cutting zone associated with each cutting element 206. Cutting layer 232 may have a flat or planar cutting face 234, but may also have a curved cutting face 234. In some embodiments, cutting face 234 may have multiple cutting surfaces and/or cutting edges with a variety of different properties, such as, hardnesses, configurations, and/or impact resistance or other properties based on material used, such as diamond grain size, and treatment, such as leaching.

Substrate 230 contains a rotating substrate portion on which cutting layer 232 is disposed, and stable substrate portion, which may be attached to a downhole tool. Substrate 230 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide and cemented or sintered tungsten carbide. Substrate 230 may also be formed using other hard materials, which may include various metal alloys and cements such as metal borides, metal carbides, metal oxides and metal nitrides. Additionally, various binding metals may be included in the substrate 230, such as cobalt, nickel, iron, metal alloys, or mixtures thereof. For some applications, cutting layer 232 may be formed from substantially the same materials as the substrate. In other applications, cutting layer 232 may be formed from different materials than the substrate. Examples of materials used to form cutting layer 232 may include PCD, including synthetic polycrystalline diamonds, thermally stable polycrystalline diamond (TSP), and other suitable materials. In some embodiments, to form cutting layer 232, a rotating substrate portion may be placed proximate to a layer of ultra-hard material particles, e.g., diamond particles, and subjected to high temperature and pressure to result in recrystallization and formation of a polycrystalline material layer, e.g. PCD layer. Cutting layer 232 and rotating substrate portion may be formed as two distinct components of the cutting element 206, or cutting layer 232 and a rotating substrate portion may alternatively be integrally formed. In some embodiments, cutting layer 232 may include different configurations of cutting edges and/or cutting surfaces. The properties of cutting edges and cutting surfaces of cutting layer 232 may be based on a characteristic of the formation to be cut by the drill bit. Further, cutting layer 232 may have sections (e.g., cutting edges and/or cutting surfaces) with a variety of different properties, such as, hardnesses, configurations, and/or impact resistance or other properties based on material used, such as diamond grain size, and treatment, such as leaching. Although shown in FIGS. 3A though 8E below with particular numbers of different cutting edge or cutting surface configurations, cutting layer 232 may have any number of cutting edge or cutting surface properties, such as, hardnesses, configurations, and/or impact resistance or other properties based on material used, such as diamond grain size, and treatment, such as leaching. Examples of cutting edges or cutting surfaces that may be configured on cutting element 232 are discussed with reference to FIGS. 3A through 8E below.

In some embodiments, cutting layer 232 may be able to cut different formations due to different properties of different sections of cutting layer 232. As cutting layer 232 contacts a formation, shearing of the formation may cause the cutting layer to rotate with respect to a stable substrate portion. Rotation of cutting layer 232 may allow different sections (e.g., cutting edges or cutting surfaces) of cutting layer 232 to contact the formation. As such, once one section of cutting layer 232 becomes worn, the cutting layer may rotate with respect to a stable substrate portion so that a different section of cutting layer contacts the formation. Cutting layer 232 and cutting element 206 may thus have a longer effective life and increase the efficiency of drilling operations.

Figure 3A:
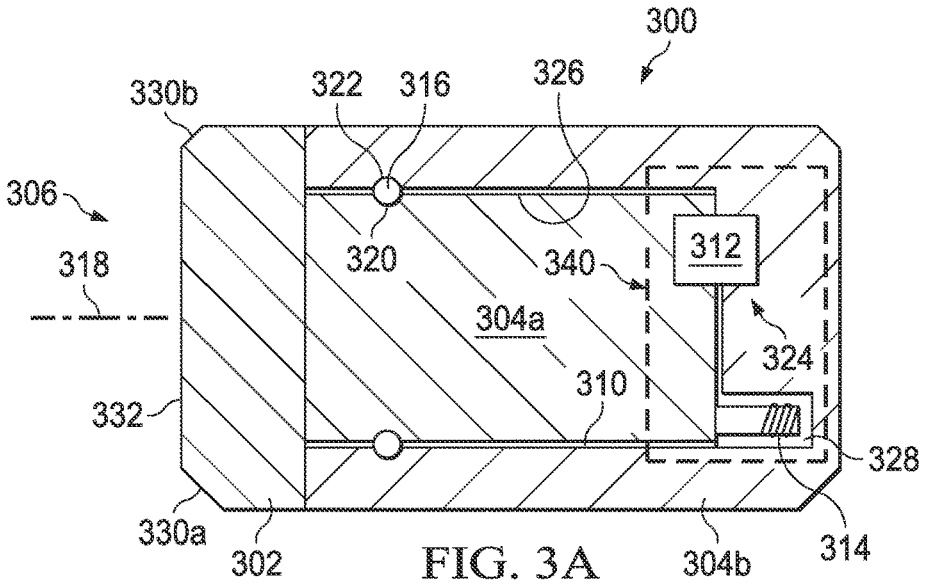
FIG. 3A illustrates a cross-sectional side view of an example rotating cutting element utilizing a restraining mechanism in accordance with some embodiments of the present disclosure.

FIG. 3A illustrates a cross-sectional side view of an example rotating cutting element 300 utilizing restraining mechanism 340 in accordance with some embodiments of the present disclosure. Rotating cutting element 300 may include stable substrate portion 304*b* and associated cutting layer 302 located on rotating substrate portion 304*a*. Stable substrate portion 304*b* may include a generally cylindrical internal recess 310. Recess 310 may be configured to receive rotating substrate portion 304*a*. Rotating substrate portion 304*a* may be configured to support cutting layer 302 and rotate within recess 310 and rotate with respect to stable substrate portion 304*b*. Recess 310 may further include restraining mechanism 340. Restraining mechanism 340 may include one or more shear pins 312, one or more locking mechanisms, such as locking pins 314, or other suitable components configured to at least temporarily restrain rotating substrate portion 304*a* from rotating with respect to stable substrate portion 304*b*. Rotating substrate portion 304*a* of cutting assembly 306 may have various configurations.

Figure 3B:
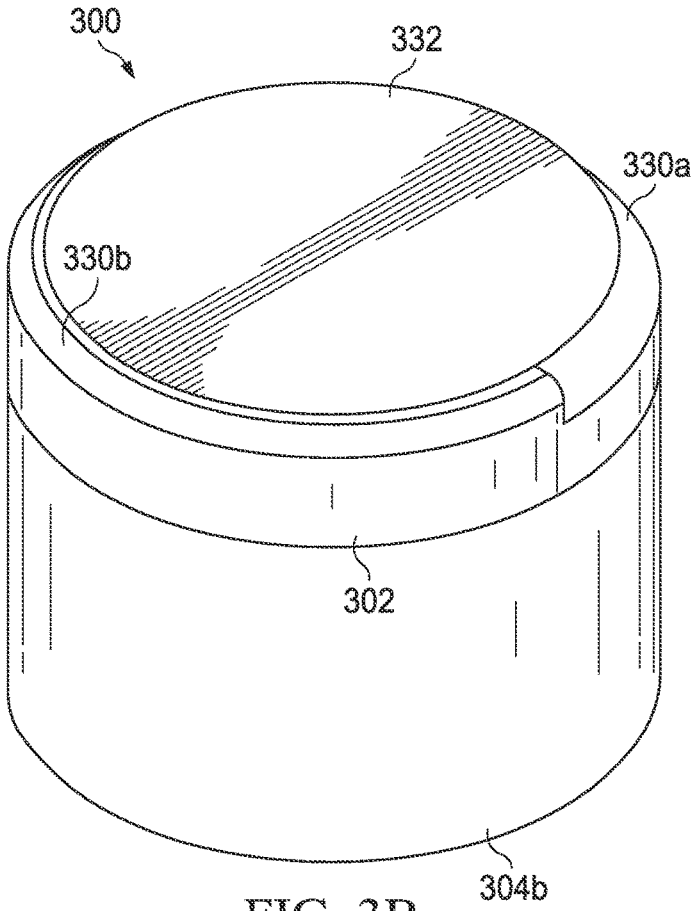
FIG. 3B illustrates an isometric view of the example rotating cutting element shown in FIG. 3A in accordance with some embodiments of the present disclosure.
Figure 3C:
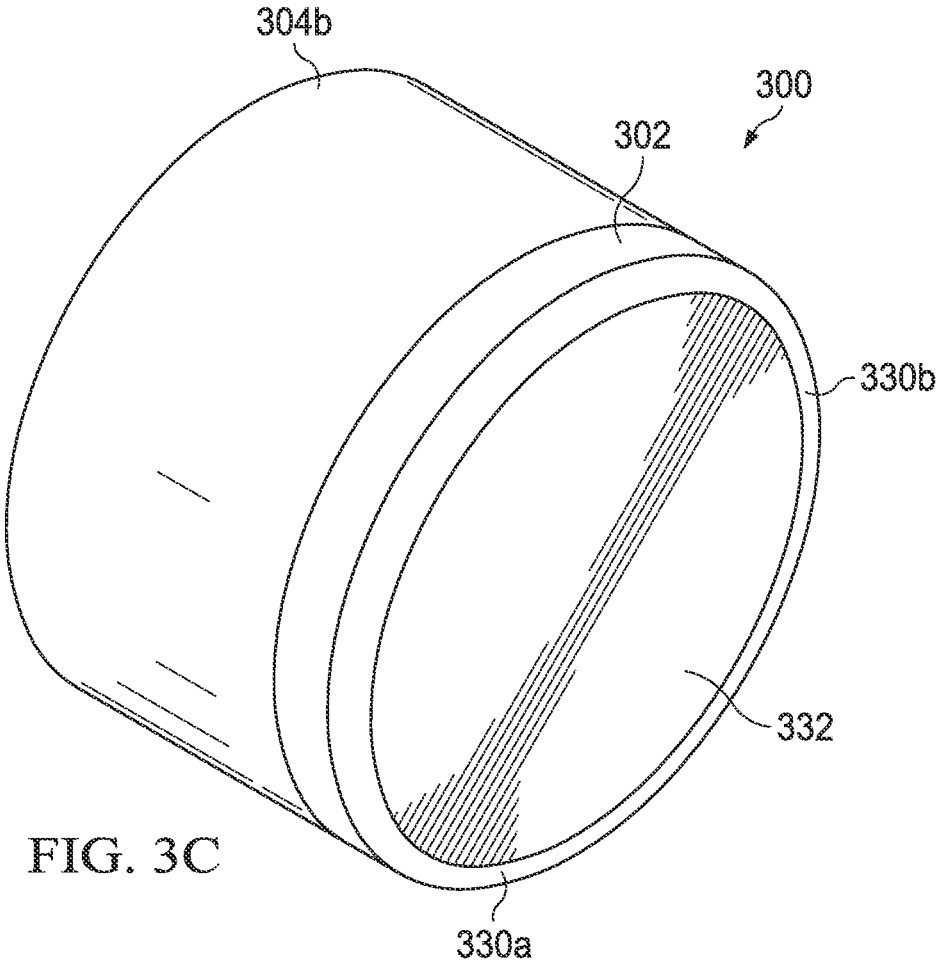
FIG. 3C illustrates a three-dimensional perspective view of example rotating cutting elements rotating cutting element that may include multi-chamfered cutting layer in accordance with some embodiments of the present disclosure.

Cutting layer 302 may be disposed on one end of rotating substrate portion 304*a*. Cutting layer 302 may be similar to cutting layer 232 discussed with reference to FIG. 2, and thus may be configured to cut through formation during drilling operations. In some embodiments, cutting layer 302 may include different configurations of cutting edges 330 and/or cutting face 332. For example, cutting edge 330*a* may be configured as a large chamfer, while on substantially the opposite side of cutting face 332, cutting edge 330*b* may be configured as a small chamfer. The configuration of cutting edges 330 and cutting face 332 may be based on a characteristic of the formation to be cut by the drill bit. Further, cutting layer 302 may have sections with different properties, such as hardnesses, configurations, and/or impact resistance or other properties based on material used, such as diamond grain size, and treatment, such as leaching. For example, FIG. 3B illustrates an isometric view of the example rotating cutting element 300 shown in FIG. 3A in accordance with some embodiments of the present disclosure. In FIG. 3B, cutting edge 330*a* with a large chamfer may be located on approximately 180 degrees of cutting face 332. Cutting edge 330*b* with a small chamfer may be located on the other approximately 180 degrees of cutting face 332. FIG. 3C illustrates a three-dimensional perspective view of example rotating cutting element 300 that may include multi-chamfered cutting layer 302. Cutting layer 302 may include cutting face 332. Cutting face 332 may include varied chamfer sizes of cutting edges 330. For example, cutting edge 330*a* may be configured with an approximately 0.018 inch chamfer. Cutting edge 330*b* may be configured with an approximately 0.010 inch chamfer.

Returning to FIG. 3A, a wide variety of supporting structures and/or bearing surfaces may be used to rotatably secure each rotating substrate portion 304*a* in associated recess 310. For example, bearings, retaining balls, or retainer 316 may be used between rotating substrate portion 304*a* and recess 310 to secure rotating substrate portion 304*a* within stable substrate portion 304*b*. Retainer 316 may be any retention mechanism or device configured to allow rotating substrate portion 304*a* to rotate about its central axis 318 with respect to stable substrate portion 304*b*. For some applications, bearing surfaces associated with rotatably mounting a carrier within a substrate may be formed as integral components (not expressly shown) disposed on exterior portions of an associated carrier and interior portions of a recess formed within an associated substrate. In some embodiments, retainer 316 may include retaining balls or other ball bearing mechanism that may be disposed in an annular array (not expressly shown) within associated inner ball race 320 formed in rotating substrate portion 304*a* and outer ball race 322 formed in adjacent interior portions of recess 310 of stable substrate portion 304*b*. When cutting assembly 306 is properly installed in stable substrate portion 304*b*, inner race 320 and outer race 322 may be substantially aligned, and the space defined between inner race 320 and outer race 322 may be generally occupied by the ball bearings.

In some embodiments, retainer 316 may include one or more pins or a mechanical interlocking device that rotatably secures rotating substrate portion 304*a* within recess 310. Moreover, multiple retention mechanisms or retainers 316 may be used. Retainer 316 may be made of any material capable of withstanding compressive forces acting while the cutting assembly 306 engages the formation. In some embodiments, for example, retainer 316 may be made of steel, a steel alloy, carbide (e.g., tungsten carbide, silicon carbide, etc.), or any other suitable material. Once inserted, retainer 316 may prevent disengagement of rotating substrate portion 304*a* from stable substrate portion 304*b*.

Restraining mechanism 340 may include one or more shear pins 312 located within recess 310 of stable substrate portion 304*b*. In some embodiments, shear pin 312 may be made of metal or metal alloy, such as steel or brass. Shear pin 312 may extend into groove or cavity 324 within recess 310. Shear pin 312 may also extend into groove or cavity 326 within rotating substrate portion 304*a* that is sized to accommodate shear pin 312. When seated in groove 324, shear pin 316 may substantially prevent rotating substrate portion 304*a* and cutting assembly 306 from rotating around axis 318 until a predefined force is exerted on shear pin 316. During operation, a force may be applied to cutting assembly 306 based on contact of cutting layer 302 with the formation. The force, once it increases to a predefined force, may cause shear pin 312 to shear, thereby permitting cutting assembly 306 to rotate with respect to stable substrate portion 304*b*. Cutting assembly 306 may rotate with respect to stable substrate portion 304*b* until groove 326 reaches an additional shear pin (not expressly shown), stop in the mating surface, or locking mechanism, such as locking pin 314, at which point the additional shear pin or locking mechanism may extend into groove 326 and substantially prevent cutting assembly 306 from further rotation with respect to stable substrate portion 304*b* at least temporarily.

As example, locking pin 314 may include a spring-loaded plunger that, when engaged, extends through and couples rotating substrate portion 304*a* and stable substrate portion 304*b*. Locking pin 314 may be coupled to or formed as part of cavity 310. For example, locking pin 314 may be configured in recess or groove 328 of stable substrate portion 304*b*. When locking pin 314 is engaged with rotating substrate portion 304*a*, rotating substrate portion 304*a* may be prevented from rotational movement with respect to stable substrate portion 304*b*.

In some embodiments, locking pin 314 may be configured and located relative to one or more shear pins 312 to allow rotating substrate portion 304*a* to rotate a defined number of degrees with respect to stable substrate portion 304*b*. For example, locking pin 314 may be located such that when shear pin 312 shears, rotating substrate portion 304*a* rotates approximately ninety degrees around axis 318. Although discussed with reference to a rotation of approximately ninety degrees, the amount of rotation may range from approximately ten degrees to approximately 180 degrees depending on the characteristics of the formation to be cut or other parameters.

Figure 3D:
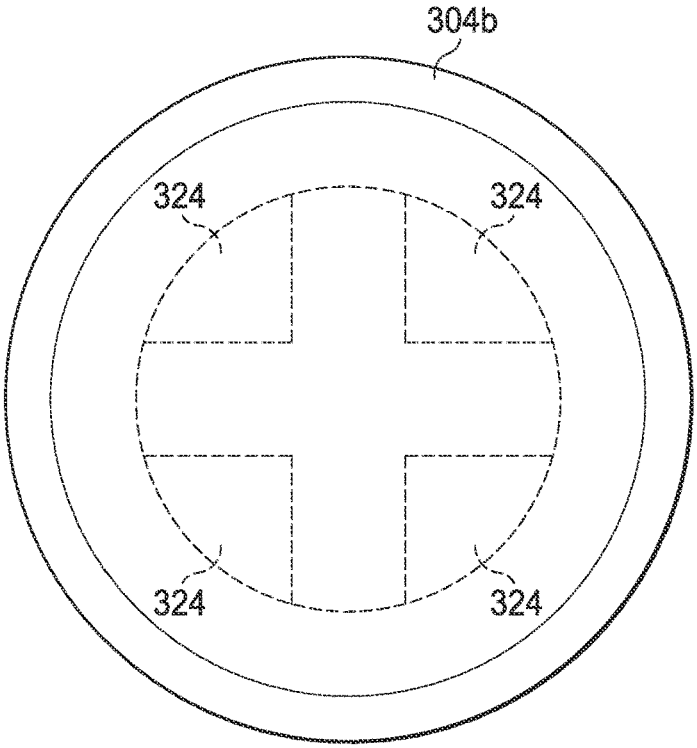
FIG. 3D illustrates a exemplary top view of a substrate of the example rotating cutting element shown in FIG. 3A in accordance with some embodiments of the present disclosure.

In some embodiments, as noted, rotating cutting element 300 may include additional shear pins 312 that engage in place of locking pin 314, such that the additional shear pins 312 may shear at different predefined forces. For example, FIG. 3D illustrates an exemplary top view of stable substrate portion 304*b* of rotating cutting element 300 shown in FIG. 3A in accordance with some embodiments of the present disclosure. Stable substrate portion 304*b* may include multiple recesses 324 for use of multiple shear pins 312 and/or locking pins 314. Use of multiple shear pins 312 may allow a ratcheting rotation of cutting assembly 306 within cavity 310 and with respect to stable substrate portion 304*b*. For example, a second shear pin may be configured in a second recess 324 such that when the first shear pin shears, the second shear pin engages after a rotation of approximately ninety degrees of rotating substrate portion 304*a* around axis 318. When the second shear pin shears, locking pin 314 or a third shear pin may engage after ninety degrees of rotation of rotating substrate portion 304*a* around axis 318. This one-way, ratcheting movement of rotating substrate portion 304*a* allows use of multiple sections of cutting layer 302. Although FIG. 3D shows a defined number of recesses 324, more or fewer recesses may be employed.

In some embodiments, other restraining mechanisms 340 may be utilized to restrain rotating substrate portion 304*a* and cutting layer 302 from rotating around axis 318, at least temporarily. For example, a plug (not expressly shown) may be utilized as a temporary block to keep rotating substrate portion 304*a* from rotating with respect to stable substrate portion 304*b*. The plug may be formed from a degradable or dissolvable (collectively referred to as dissolvable) material such as polylactic acid (PLA); a pliable water, oil, or gas soluble resin; or any other suitable dissolvable material. Rotating cutting element 300 may be configured to have a fluid flow proximate to the plug and dissolve the plug. When the plug is dissolved, rotating substrate portion 304*a* may rotate a defined number of degrees with respect to stable substrate portion 304*b* until rotation is halted by use of a locking pin, an additional plug, or other suitable component. Additionally, any other types of stops in any of the mating surfaces may be employed to restrain rotating substrate portion 304*a*, at least temporarily.

Figure 4:
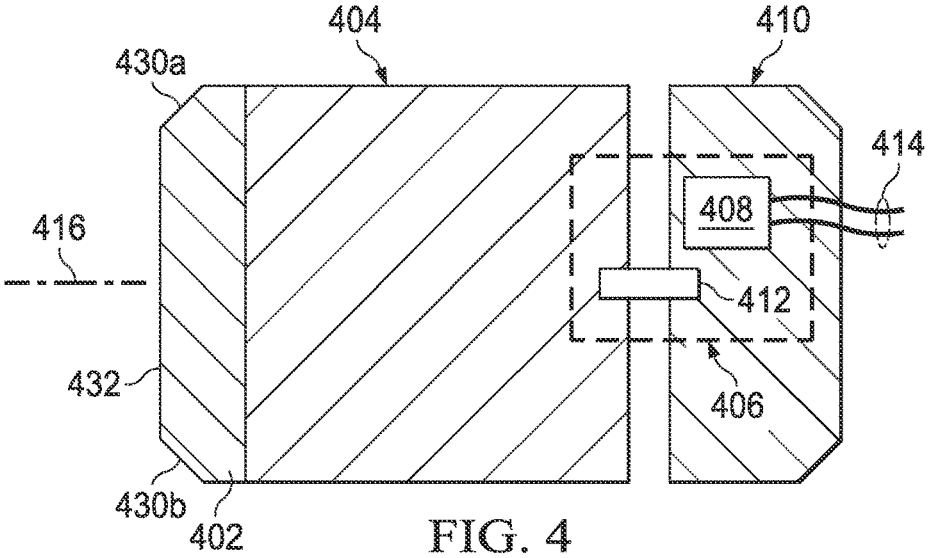
FIG. 4 illustrates a cross-sectional side view of an example rotating cutting element utilizing an electro-mechanical mechanism in accordance with some embodiments of the present disclosure.

FIG. 4 illustrates a cross-sectional side view of an example rotating cutting element 400 utilizing electro-mechanical mechanism 406 in accordance with some embodiments of the present disclosure. Rotating cutting element 400 may include cutting layer 402, rotating substrate section 404, stable substrate section 410, and associated electro-mechanical mechanism 406. Electro-mechanical mechanism 406 may be any suitable rotation inducing mechanism and may include a variety of components, including, but not limited to, actuator 408, rod 412, and wiring 414. Actuator 408 may be any suitable device to cause rod 412 to rotate rotating substrate section 404 with respect to stable substrate portion 410. For example, actuator 408 may be a motor, such as a piezoelectric motor, a magneto-resistive motor, or any other suitable motor. Actuator 408 configured to rotate rotating substrate section 404 with respect to stable substrate portion 410 such that a particular portion of cutting layer 402 comes in contact with the formation. Actuator 408 may be communicatively coupled, for example via an electrical conductor such as wiring 414, to a BHA, such as BHA 120 shown in FIG. 1, to a component at the well surface, to a downhole sensor, or to any other suitable component. In some embodiments, actuator 408 may be activate or deactivate based on a received signal. For example, signals to actuator 408 may be passed from the well surface via a telemetry communication interface system that permits communications with the drill bit, drill string and/or BHA telemetry system. Actuator 408, when activated may cause rod 412 to rotate rotating substrate section 404 and cutting layer 402 a defined number of degrees around axis 416 and with respect to stable substrate portion 410. For example, actuator 408 may cause rod 412 to rotate rotating substrate section 404 approximately ninety degrees around axis 416 based on a received signal.

Stable substrate section 410 of rotating cutting element 400 may have various configurations and may be formed of the same materials as rotating substrate section 404. Stable substrate section 410 may be secured, e.g., brazed, into a cutter pocket of a drill bit, such as cutter pocket 240 of drill bit 101 discussed with reference to FIG. 2.

Rod 412 may couple stable substrate section 410 with rotating substrate section 404. In some embodiments, rod 412 may be made of metal or metal alloy, such as steel or brass. Rod 412 may extend into a groove or cavity within stable substrate section 410 and rotating substrate section 404. Further, actuator 408 may be configured in a cavity or recess of stable substrate section 410 or may be enclosed within stable substrate section 410.

Cutting layer 402 may be disposed on one end of rotating substrate section 404. Cutting layer 402 may be similar to cutting layer 232 discussed with reference to FIG. 2, and thus may be configured to cut through formation during drilling operations. Further, as discussed with reference to FIG. 3B, cutting face 432 may be include a variety of configurations or formations around cutting edge 330. For example, cutting edge 430*a* with a large chamfer may be located on approximately 180 degrees of cutting face 432. Cutting edge 430*b* with a small chamfer may be located on the other approximately 180 degrees of cutting face 432.

Figure 5A:
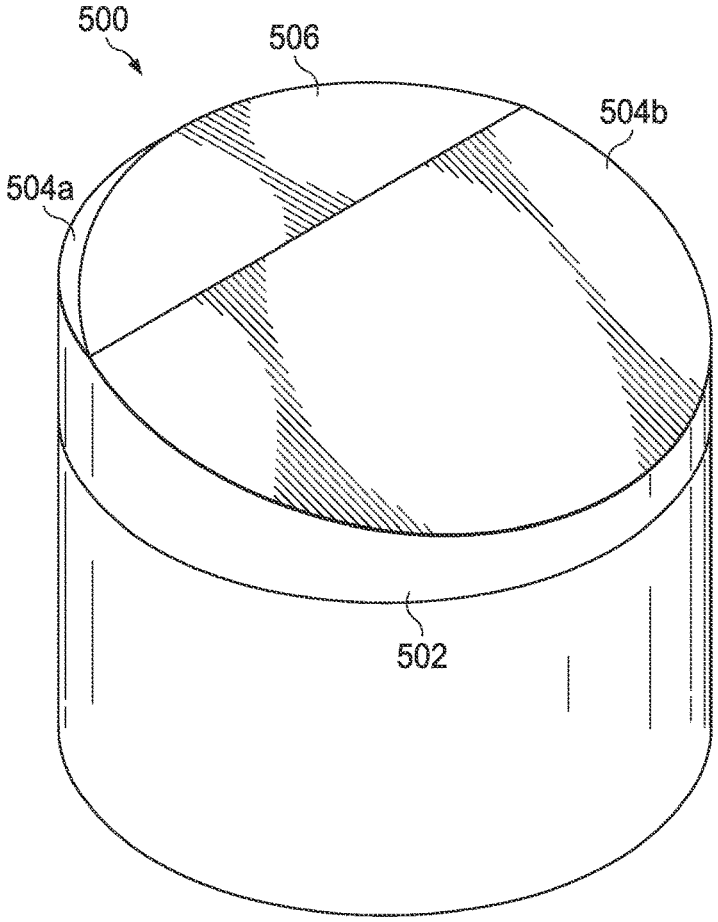
FIGS. 5A and 5B illustrate exemplary three-dimensional perspective and cross-sectional views, respectively, of an example rotating cutting element with a chamfered edge and a planar edge in accordance with some embodiments of the present disclosure.
Figure 5B:
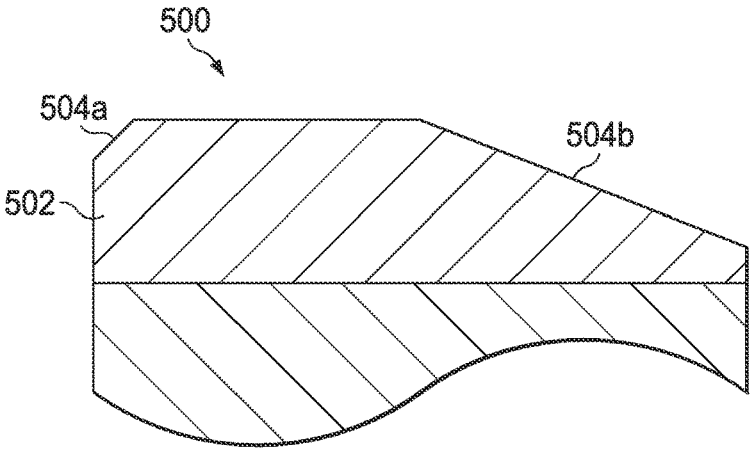

FIGS. 5A and 5B illustrate exemplary three-dimensional perspective and cross-sectional views, respectively, of example rotating cutting element 500 with chamfered edge 504*a* and planar edge 504*b* in accordance with some embodiments of the present disclosure. In this embodiment, cutting layer 502 may be formed such that a portion of cutting face 506 is configured with planar edge 504*b* and a different portion of cutting face 506 is configured with chamfered edge 504*a*. Chamfered edge 504*a* may be rotated with respect to a stable substrate portion to cut into the formation when the formation includes particular characteristics. For example, formations that are may shear relatively easily may be removed more efficiently using a small chamfered edge over a planar edge. Planar edge 504*b* may be rotated with respect to a stable substrate portion to cut into the formation when the formation includes particular characteristics. For example, formations that do not shear relatively easily may be removed more efficiently using a planar edge over a chamfered edge. Although illustrated with a chamfered edge and a planar edge with a particular configuration and a particular size ratio, embodiments of the present disclosure contemplate any number of chamfered edges, beveled edges, non-planar edges, and planar edges and any suitable sizes for any of the chamfered edges, beveled edges, non-planar edges, and planar edges. Moreover, the cutting face may be formed any of a variety of materials with a variety of different properties, such as, hardnesses, configurations, and/or impact resistance or other properties based on material used, such as diamond grain size, and treatment, such as leaching.

Figure 6A:
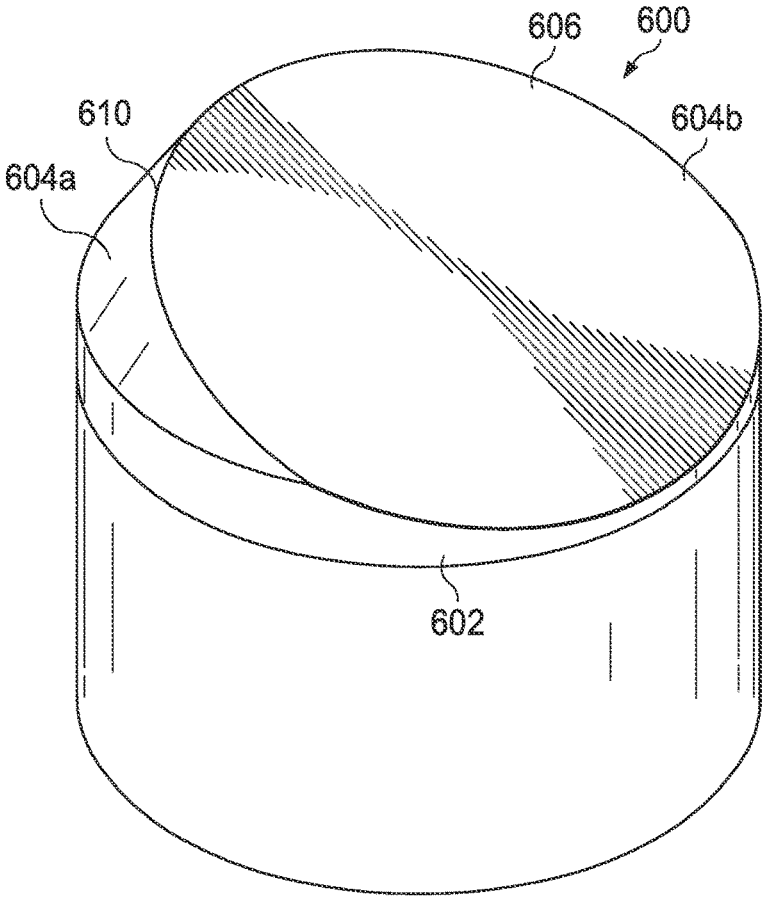
FIGS. 6A and 6B illustrate exemplary three-dimensional perspective and cross-sectional views, respectively, of an example rotating cutting element with a first planar edge and a second planar edge in accordance with some embodiments of the present disclosure.
Figure 6B:
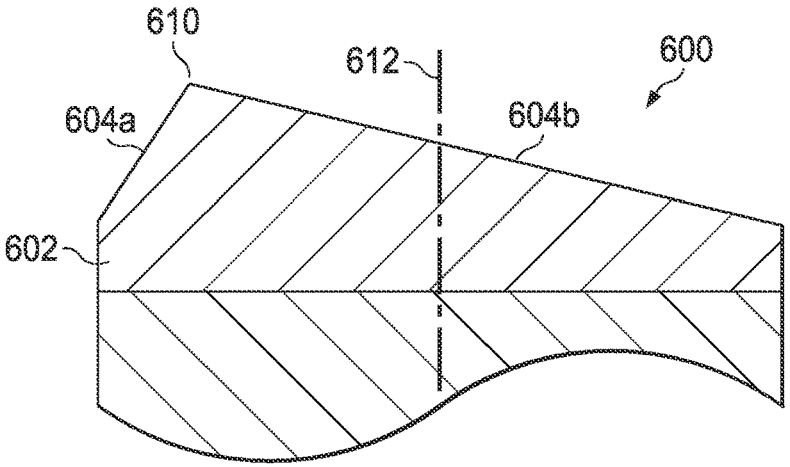

FIGS. 6A and 6B illustrate exemplary three-dimensional perspective and cross-sectional views, respectively, of example rotating cutting element 600 with first planar edge 604*a* and second planar edge 604*b* in accordance with some embodiments of the present disclosure. In this embodiment, cutting layer 602 may be formed such that a portion of cutting face 606 is configured with first planar edge 604*a* and another portion of cutting face 606 is configured with second planar edge 604*b*. First planar edge 604*a* may be rotated with respect to a stable substrate portion to cut into the formation when the formation includes particular characteristics. Second planar edge 604*b* may be rotated with respect to a stable substrate portion to cut into the formation when the formation includes particular characteristics. For example, the planar edge used may be based on the hardness of the formation to be removed. Further, the size of each planar edge 604 may vary based upon formation characteristics. For example, apex 610 between first planar edge 604*a* and second planar edge 604*b* may be offset from cutting element axis 612. Although illustrated with two planar edges and a particular size ratio, embodiments of the present disclosure contemplate any number of planar edges and any suitable sizes for any of the planar edges. Moreover, the cutting face may be formed any of a variety of materials with a variety of different properties, such as, hardnesses, configurations, and/or impact resistance or other properties based on material used, such as diamond grain size, and treatment, such as leaching.

Figure 7A:
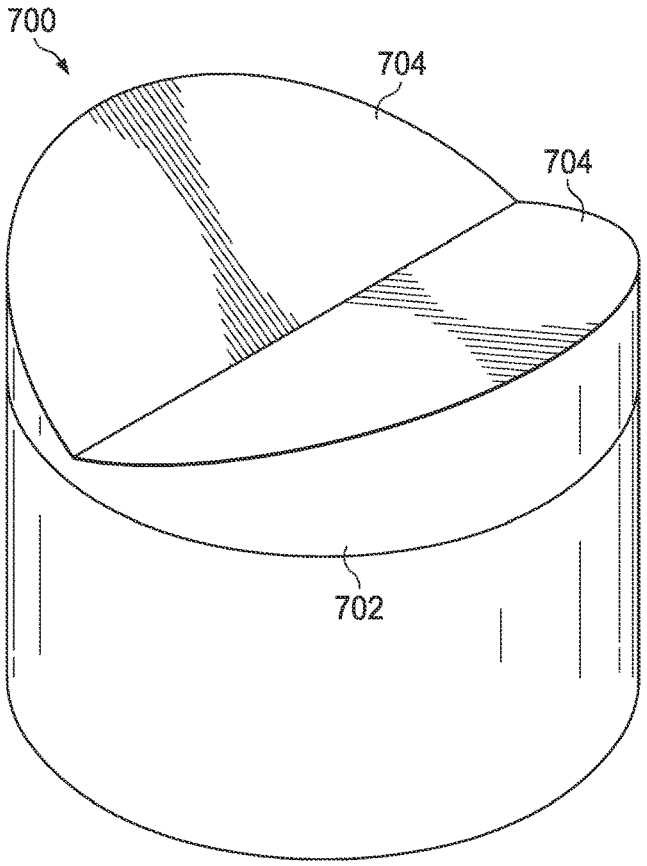
FIGS. 7A and 7B illustrate exemplary three-dimensional perspective and cross-sectional views, respectively, of an example rotating cutting element with cutting layer utilized for chip breaking in accordance with some embodiments of the present disclosure.
Figure 7B:
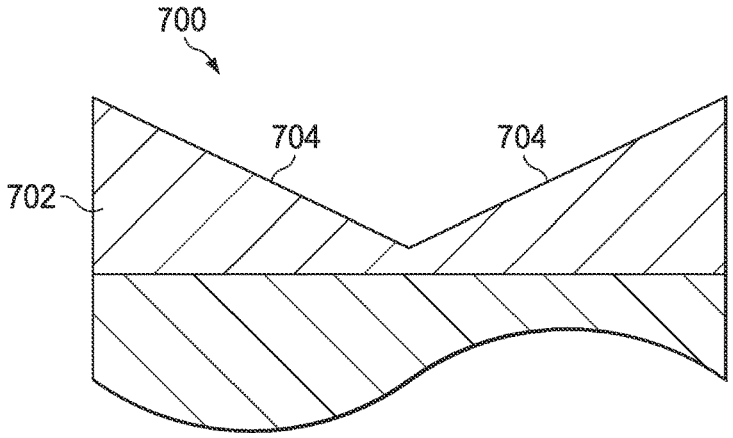

FIGS. 7A and 7B illustrate exemplary three-dimensional perspective and cross-sectional views, respectively, of rotating cutting element 700 with cutting layer 702 utilized for chip breaking in accordance with some embodiments of the present disclosure. Rotating cutting elements 700 utilized for chip breaking bits may be configured to reflect the rock chipped from the formation in one or more particular directions or in a particular manner. As such, cutting layer 702 may be configured in a v-shaped formation and the cutting surfaces 704 may be rotated with respect to a stable substrate portion as needed based on the desired direction for the rock chipped from the formation. Although illustrated with a v-shaped formation and a particular size ratio, embodiments of the present disclosure contemplate any suitably shaped formation, e.g., a u-shaped formation, and any suitable sizes for any of the cutting surfaces. Moreover, the cutting surfaces may be formed any of a variety of materials with a variety of different properties, such as, hardnesses, configurations, and/or impact resistance or other properties based on material used, such as diamond grain size, and treatment, such as leaching.

FIGS. 8A through 8E illustrate exemplary three-dimensional perspective views of example rotating cutting elements with varied cutting layers in accordance with some embodiments of the present disclosure. The cutting layers illustrated in FIGS. 8A through 8E may include different cutting surfaces that may include different cutting edges. Although illustrated with cutting surfaces with various characteristics and combinations, embodiments of the present disclosure contemplate any suitable characteristics or combination of characteristics on any cutting surfaces.

Figure 8A:
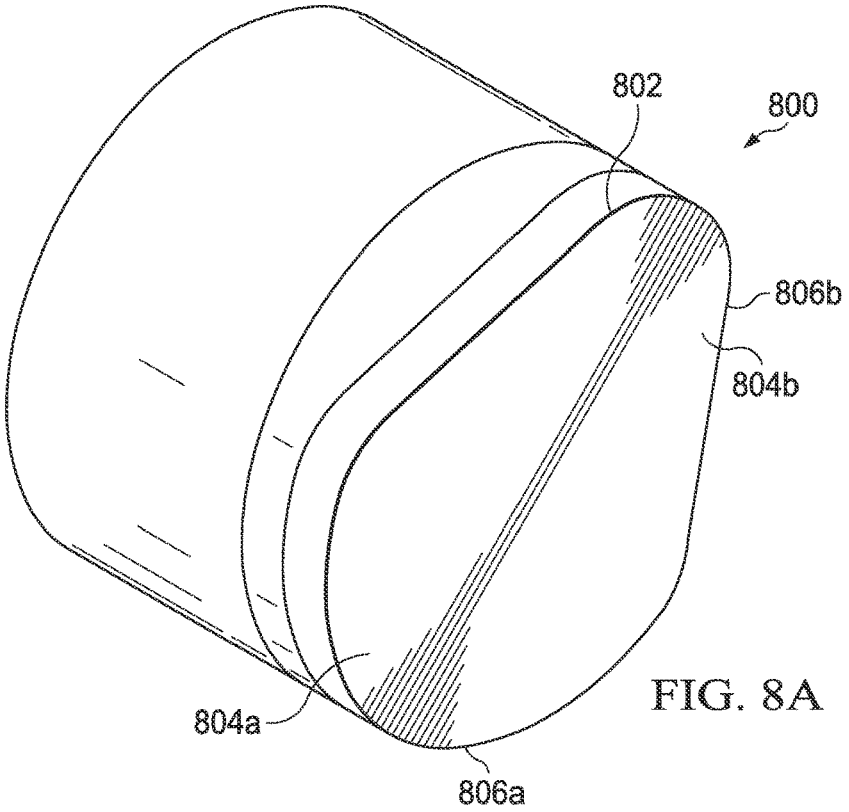
FIGS. 8A through 8E illustrate exemplary three-dimensional perspective views of example rotating cutting elements with varied cutting layers in accordance with some embodiments of the present disclosure.

FIG. 8A illustrates rotating cutting element 800 that may include cam-shaped cutting layer 802. Cutting layer 802 may include cutting surfaces 804*a* and 804*b*. Cutting surfaces 804*a* and 804*b* may include multiple varied properties, such as varied configurations of cutting edges 806. For example, cutting edge 806*a* may be substantially round shaped. Cutting edge 806*b* may include a scribe edge such that a portion of cutting layer 802 may have a non-circular shape, for example, an approximately triangular shape.

Figure 8B:
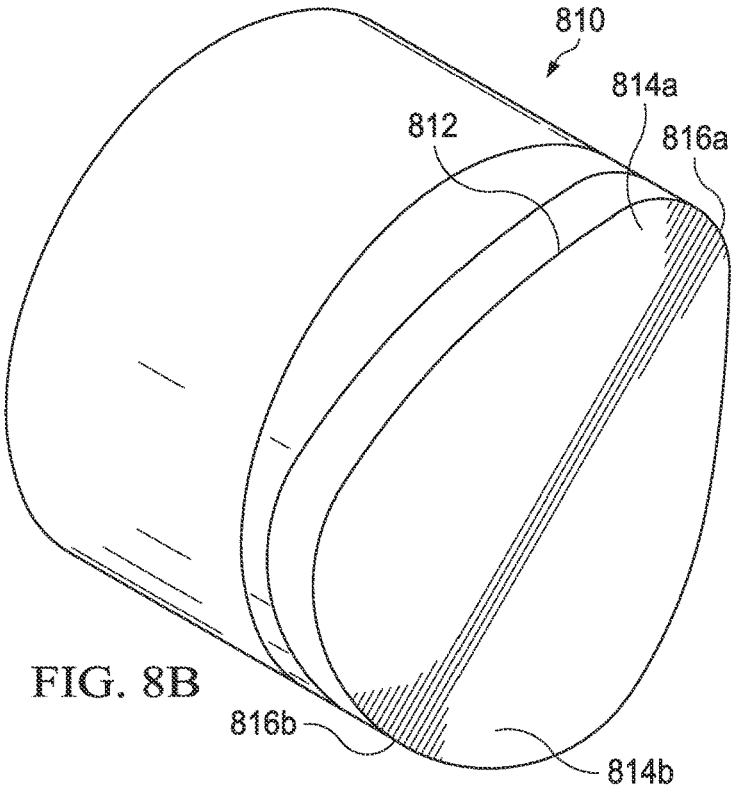

FIG. 8B illustrates rotating cutting element 810 that may include multi-diameter cutting layer 812. Cutting layer 812 may include cutting surfaces 814*a* and 814*b*. Cutting surfaces 814*a* and 814*b* may include varied shapes of cutting edges 816. For example, cutting edges 816*a* and 816*b* may be configured based on multiple varied diameters and/or radii. As such, diameter of cutting edge 816*a* may be approximately 13 millimeters. The diameter of cutting edge 816*b* may be approximately 16 millimeters.

Figure 8C:
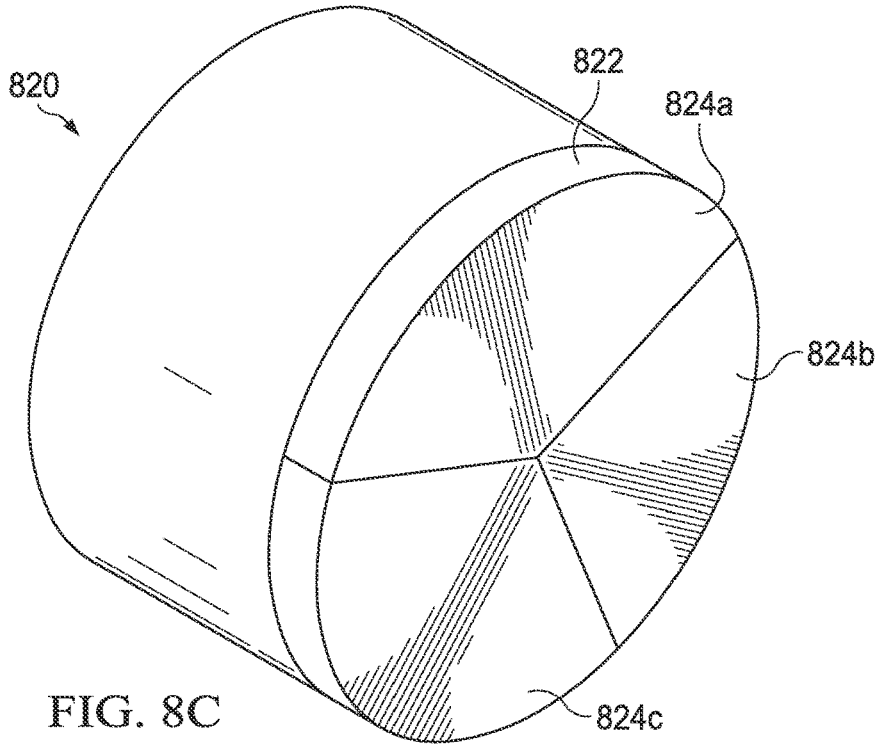

FIG. 8C illustrates rotating cutting element 820 that may include multi-constituent cutting layer 822. Cutting layer 822 may include cutting surfaces 824*a*, 824*b*, and 824*c*. Cutting surfaces 824*a*, 824*b*, and 824*c* may be configured based on multiple varied properties, such as varied types of cutting material formation. For example, cutting surface 824*a* may be balanced impact and abrasion diamond. Cutting surface 824*b* may be high impact diamond. Further, cutting surface 824*c* may be high abrasion diamond. The materials used to form cutting surfaces 824 may vary based on grain size, density, elements or other characteristics.

Figure 8D:
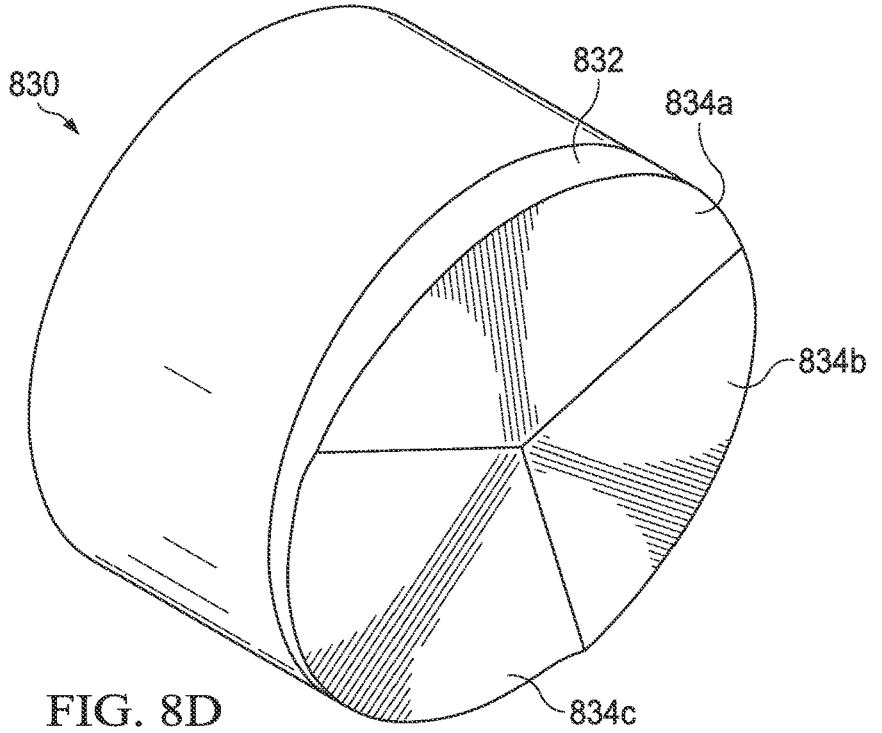

FIG. 8D illustrates rotating cutting element 830 that may include multi-backrake cutting layer 832. Cutting layer 832 may include cutting surfaces 834*a*, 834*b*, and 834*c*. Cutting surfaces 834*a*, 834*b*, and 834*c* may be configured based on multiple varied properties, such as varied backrake angles. For example, cutting surface 834*a* may have an approximately 0 degree backrake. Cutting surface 834*b* may have an approximately 10 degree backrake. Further, cutting surface 834*c* may have an approximately 20 degree backrake.

Figure 8E:
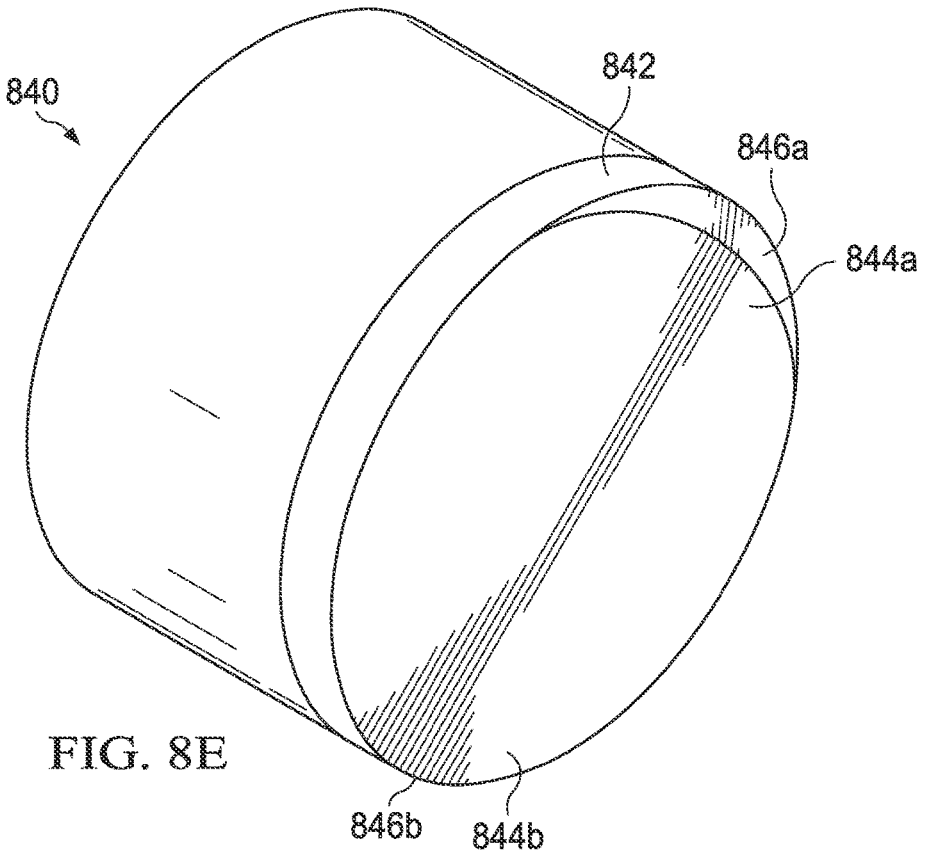

FIG. 8E illustrates rotating cutting element 840 that may include multi-wear cutting layer 842. Cutting layer 842 may include cutting surfaces 844*a* and 844*b*. Cutting surfaces 844*a* and 844*b* may include cutting edges 846 with varied properties, such as varied amounts of wear. For example, cutting edge 846*a* may be worn to a particular level due to prior use. Cutting edge 846*b* may be substantially unworn. The cutting edges 846 of cutting layer 842 may have any level of wear in embodiments of the present disclosure.

Embodiments disclosed herein include:

A. A rotating cutting element that includes a substrate including a rotating portion and a stable portion. The stable portion has a cavity and is configured to be fixed to a blade of a drill bit. The rotating cutting element further includes a retainer that rotatably secures the rotating portion of the substrate in the cavity of the stable portion of the substrate. Additionally, the rotating cutting element includes a cutting layer on the rotating portion of the substrate. The cutting layer has a plurality of cutting surfaces, and one of the plurality of cutting surfaces has a property different from another one of the plurality of cutting surfaces. The cutting layer is configured to rotate with respect to the stable portion of the substrate and use one of the plurality of cutting surfaces based on a characteristic of a formation to be cut.

B. A drill bit includes a bit body and a blade on an exterior portion of the bit body. The drill bit further includes a rotating cutting element on the blade. The rotating cutting element includes a substrate including a rotating portion and a stable portion. The stable portion has a cavity and is configured to be fixed to the blade. The rotating cutting element further includes a retainer that rotatably secures the rotating portion of the substrate in the cavity of the stable portion of the substrate. Additionally, the rotating cutting element includes a cutting layer on the rotating portion of the substrate. The cutting layer has a plurality of cutting surfaces, and one of the plurality of cutting surfaces has a property different from another one of the plurality of cutting surfaces. The cutting layer is configured to rotate with respect to the stable portion of the substrate and use one of the plurality of cutting surfaces based on a characteristic of a formation to be cut.

Each of embodiments, A and B may have one or more of the following additional elements in any combination: Element 1: wherein the property is a chamfer. Element 2: wherein the property is a backrake angle. Element 3: wherein the property is a cutting material. Element 4: wherein the property is a radius. Element 5: wherein the cutting layer has a cutting face that is non-circular. Element 6: further comprising a restraining mechanism configured in the cavity and retains the rotating portion in a position until a rotation event occurs. Element 7: wherein the restraining mechanism comprises a shear pin. Element 8: wherein the rotation event comprises sufficient force applied to the cutting layer to shear the shear pin. Element 9: further comprising a locking mechanism configured in the cavity, the locking mechanism configured to prevent further rotation of the rotating portion after the rotating portion has rotated a defined number of degrees. Element 11: wherein the locking mechanism comprises a locking pin. Element 12: wherein the defined number of degrees ranges from approximately ten to approximately 180 degrees. Element 13: further comprising a second restraining mechanism configured in the cavity and retains the rotating portion in a second position until a second rotation event occurs. Element 14: wherein the restraining mechanism comprises a dissolvable plug.

Although the present disclosure and its advantages have been described in detail, it should be understood that various changes, substitutions and alternations can be made herein without departing from the spirit and scope of the disclosure as defined by the following claims. It is intended that the present disclosure encompasses such changes and modifications as fall within the scope of the appended claims.

What is claimed is:

1. A rotating cutting element comprising:

a substrate comprising a rotating portion and a stable portion, the stable portion having a recess, the stable portion configured to be fixed to a blade of a drill bit;

a retainer that rotatably secures the rotating portion of the substrate in the recess of the stable portion of the substrate;

a cutting layer on the rotating portion of the substrate; the cutting layer having a plurality of cutting surfaces, one of the plurality of cutting surfaces having a property different from another one of the plurality of cutting surfaces; the cutting layer configured to rotate with respect to the stable portion of the substrate and use one of the plurality of cutting surfaces based on a characteristic of a formation to be cut;

a restraining mechanism configured in the recess that retains the rotating portion in a position until a rotation event occurs; and a locking mechanism configured in the cavity, the locking mechanism configured to prevent further rotation of the rotating portion after the rotating portion has rotated a defined number of degrees.

2. The rotating cutting element of claim 1, wherein the property is a chamfer.

3. The rotating cutting element of claim 1, wherein the property is a backrake angle.

4. The rotating cutting element of claim 1, wherein the property is a cutting material.

5. The rotating cutting element of claim 1, wherein the property is a radius.

6. The rotating cutting element of claim 1, wherein the cutting layer has a cutting face that is non-circular.

7. The rotating cutting element of claim 1, wherein the restraining mechanism comprises a shear pin.

8. The rotating cutting element of claim 1, wherein the rotation event comprises sufficient force applied to the cutting layer to shear a shear pin.

9. The rotating cutting element of claim 1, wherein the locking mechanism comprises a locking pin.

10. The rotating cutting element of claim 1, wherein the defined number of degrees ranges from approximately ten to approximately 180 degrees.

11. The rotating cutting element of claim 1, further comprising a second restraining mechanism configured in the recess and retains the rotating portion in a second position until a second rotation event occurs.

12. The rotating cutting element of claim 1, wherein the restraining mechanism comprises a dissolvable plug.

13. A drill bit comprising:

a bit body;

a blade on an exterior portion of the bit body;

a rotating cutting element on the blade and comprising:

a substrate comprising a rotating portion and a stable portion, the stable portion having a recess, the stable portion configured to be fixed to the blade;

a retainer that rotatably secures the rotating portion of the substrate in the recess of the stable portion of the substrate;

a cutting layer on the rotating portion of the substrate; the cutting layer having a plurality of cutting surfaces, one of the plurality of cutting surfaces having a property different from another one of the plurality of cutting surfaces; the cutting layer configured to rotate with respect to the stable portion of the substrate and use one of the plurality of cutting surfaces based on a characteristic of a formation to be cut; and a restraining mechanism configured in the recess that retains the rotating portion in a position until a rotation event occurs; and a locking mechanism configured in the cavity, the locking mechanism configured to prevent further rotation of the rotating portion after the rotating portion has rotated a defined number of degrees.

14. The drill bit of claim 13, wherein the property is a chamfer.

15. The drill bit of claim 13, wherein the property is a backrake angle.

16. The drill bit of claim 13, wherein the property is a cutting material.

17. The drill bit of claim 13, wherein the property is a radius.

18. The drill bit of claim 13, wherein the cutting layer has a cutting face that is non-circular.

19. A rotating cutting element comprising:

a substrate comprising a rotating portion and a stable portion, the stable portion having a cavity recess, the stable portion configured to be fixed to a blade of a drill bit;

a retainer that rotatably secures the rotating portion of the substrate in the cavity recess of the stable portion of the substrate;

a cutting layer on the rotating portion of the substrate; the cutting layer having a plurality of cutting surfaces, one of the plurality of cutting surfaces having a property different from another one of the plurality of cutting surfaces, the cutting layer configured to rotate with respect to the stable portion of the substrate and use a different one of the plurality of cutting surfaces having a different property; and a restraining mechanism configured in the recess and having:

a component extending into a first groove or cavity within the recess or a second groove or cavity within the rotating substrate portion and configured to temporarily restrain the rotating portion from rotating with respect to the stable portion until a rotation event occurs, and to allow rotation of the rotating mechanism after the rotation event occurs; and a locking mechanism, extending into a third groove or cavity within the recess or a fourth groove or cavity within the rotating substrate portion and configured to prevent further rotation of the rotating portion after the rotating portion has rotated a defined number of degrees.

20. The rotating cutting element of claim 19, wherein the component configured to temporarily restrain the rotating portion from rotating with respect to the stable portion comprises a shear pin or a dissolvable plug.

* * * * *